US005934884A

United States Patent [19]

Son

[11] Patent Number: 5,934,884

[45] Date of Patent: Aug. 10, 1999

[54] STATOR STOPPER STRUCTURE FOR HERMETIC COMPRESSOR

[75] Inventor: Yong Uk Son, Chinhae, Rep. of Korea

[73] Assignee: LG Electronics, Inc., Rep. of Korea

[21] Appl. No.: 08/989,571

[22] Filed: Dec. 12, 1997

[30] Foreign Application Priority Data

Dec. 17, 1996 [KR] Rep. of Korea ..... 96-66637

[51] Int. Cl.[6] ..... F04B 35/04

[52] U.S. Cl. ..... 417/363; 310/51

[58] Field of Search ..... 417/363; 310/51

[56] References Cited

U.S. PATENT DOCUMENTS 4,544,334 10/1985 Ellis ..... 417/360

5,252,038 10/1993 Mangyo et al. ..... 417/363

5,772,410 6/1998 Chang ..... 417/363

*Primary Examiner*—Timothy S. Thorpe

*Assistant Examiner*—Ehud Gartenberg

*Attorney, Agent, or Firm*—Ostrolenk, Faber, Gerb & Soffen, LLP

[57] ABSTRACT

A stator stopper structure for a hermetic compressor includes a mechanism wherein one of a pair of spring supports extended downwardly from a lower surface of each of a pair of stator stoppers which support a stator in the hermetic compressor is formed shorter than the other of the pair of spring supports. The structure allows the spring supports to prevent the stator stopper which receives a larger bending momentum from being bent due to a vertical impact on the hermetic compressor during its handling or transportation.

1 Claim, 3 Drawing Sheets

STATOR STOPPER STRUCTURE FOR HERMETIC COMPRESSOR

BACKGROUND OF THE INVENTION

1. Field of the Invention

The present invention relates to a hermetic compressor, and more particularly to an improved stator stopper structure for a hermetic compressor, capable of preventing stator stoppers from undesirably crooking as well as preventing a noise occurrence resulting from an external impact which may occur when support springs hit onto the stator stoppers in a handling or transportation of the hermetic compressor.

2. Description of the Background Art

As shown in FIG. 1, a general hermetic compressor includes: a hermetically sealed container 1; a frame 2 provided inside the container 1; and a motor unit disposed below the frame 2 and including a stator 3 and a rotor 4.

Onto respective spring seats 11 disposed on corresponding lower portions in the hermetic compressor, there are fittingly provided corresponding support springs 12 which serve to support the stator 3.

A crank shaft 5 having an eccentric portion 5*a* disposed at an upper end thereof is fitted into the rotor 4. A cylinder 6 is connected to an upper portion of the frame 2.

A piston 8 is engaged to the eccentric portion 5*a* of the crank shaft 5 and horizontally reciprocates in the cylinder 6.

A valve plate 8 is attached onto an end portion of the cylinder 6, and a head cover 9 is attached onto a side portion of the valve plate 8. A suction muffler (not shown) is mounted on a portion of the head cover 9.

With reference to FIG. 1, the operation of the conventional hermetic compressor will now be described.

First, when power is applied to the motor of the hermetic compressor, the rotor 4 begins its rotation, thereby rotating the crank shaft 5 fitted into the rotor 4. Accordingly, the piston 7 connected to the eccentric portion 5*a* of the crank shaft 5 reciprocates in the cylinder 6.

With the piston 7 making its reciprocating movement, a low-temperature low-pressure refrigerant gas is drawn through a suction port (not shown) formed in a side portion of the head cover 9 into the cylinder 6. The intaken refrigerant gas is compressed into a high-temperature high-pressure refrigerant gas in the cylinder 6, and exhausted through an exhaust port (not shown) formed in another side portion of the head cover 9.

Referring to FIGS. 1 and 2, there will be now explained a stator stopper structure of the hermetic compressor, wherein a vibration caused by a rotation of the crank shaft 5 or by the refrigerant gas compression may be absorbed in the compressor.

Initially, a square type stator 3 includes a central opening 3*b* through which the rotor 4 is provided and makes its rotation therein. A pair of stator stoppers 10 are fixed by bolts 3*a* onto a lower end of the stator 3.

Spring supports 13*a*, 13*b* are downwardly extended from the lower surface of the stator stoppers 10.

Spring seats 11 corresponding to the spring supports 13*a*, 13*b* extended from the stator stoppers 10 are formed on predetermined portions of the bottom surface of a casing of the hermetic compressor.

Here, the stator stopper structure for absorbing vibration in the compressor includes a mechanism in which the support springs 12 are respectively disposed between the corresponding stator stoppers 10 mounted on the lower surface of the stator 3 and the corresponding spring seats 11 mounted on bottom portions in the hermetic compressor.

With regard to the stator stoppers 10 in the conventional hermetic compressor, the right side and left side spring supports 13*a*, 13*b* are not symmetrical with respect to an axis of the crank shaft 5. Instead, the left side spring supports 13*b* are disposed outwardly farther from the axis of the crank shaft 5 than the right side spring supports 13*a*.

Also, because respective dimensions D between the stator stoppers 10 and the spring seats 11 are identical, a vertical impact that may occur during a handling or transportation of the compressor may be applied to each side of the stator stoppers 10 in the form of an identical force F.

However, when such a force F is identically applied to each of the spring supports 13*a*, 13*b* extended from the stator stoppers 10, as shown in FIG. 3, a bending momentum inflicted on the stator stoppers 10 may become increased. Here, the spring supports 13*b* are extended from the stator stoppers 10 and are spaced farther from the axis of the crank shaft 5, compared to the stator stoppers 10 from which the spring supports 13*a* are extended, thereby causing each left portion of the stator stoppers to disadvantageously crook.

As a result, the thusly crooked stator stoppers 10 tend to cause an obstruction with regard to the support springs 12 while undergoing a compress in correspondence to the rotation of the crank shaft 5 in the hermetic compressor, thereby resulting in an undesirable noise or in worse case even causing the springs 12 to escape from the spring supports 13*b*.

SUMMARY OF THE INVENTION

Accordingly, it is an object of the present invention to provide a stator stopper structure for a hermetic compressor which prevents the stator stoppers from being undesirably crooked and noise from occurring.

To achieve the above-described object, there is provided a stator stopper structure for a hermetic compressor according to the present invention which includes a mechanism wherein one of a pair of spring supports extended downwardly from a lower surface of each of a pair of stator stoppers which support a stator in the hermetic compressor is formed shorter than the other of the pair of spring supports.

The object and advantages of the present invention will become more readily apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENT

With reference to the accompanying drawings, the stator stopper structure for a hermetic compressor according to the present invention will now be described.

Figure 1:
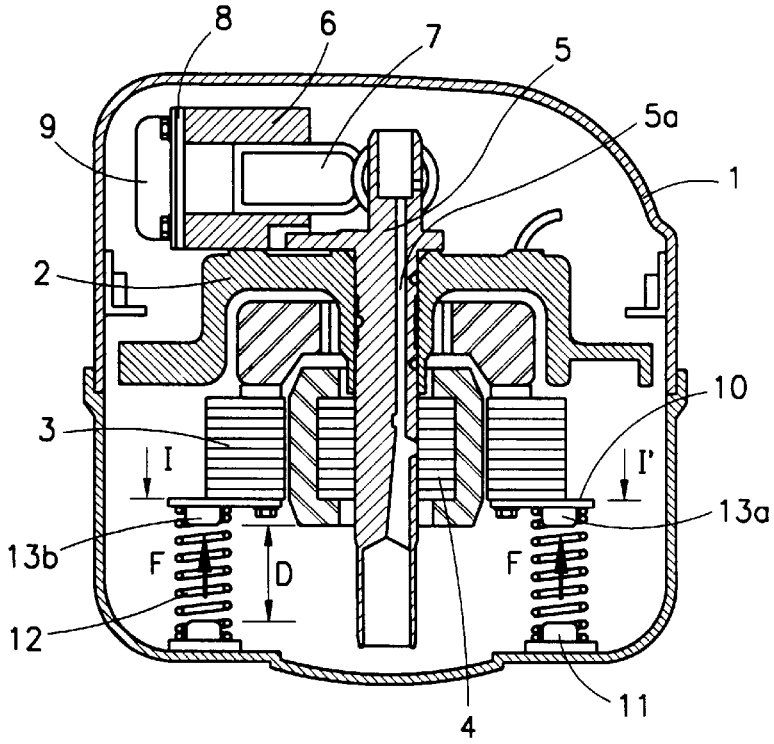
FIG. 1 CONVENTIONAL ART
FIG. 1 is a cross-sectional view illustrating a conventional hermetic compressor.
Figure 2:
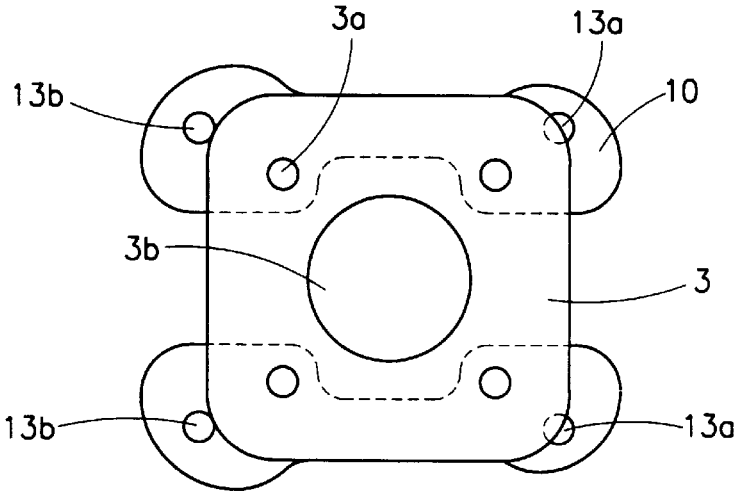
FIG. 2 CONVENTIONAL ART
FIG. 2 is a cross-sectional view taken along line 11—11' in FIG. 1.
Figure 3:
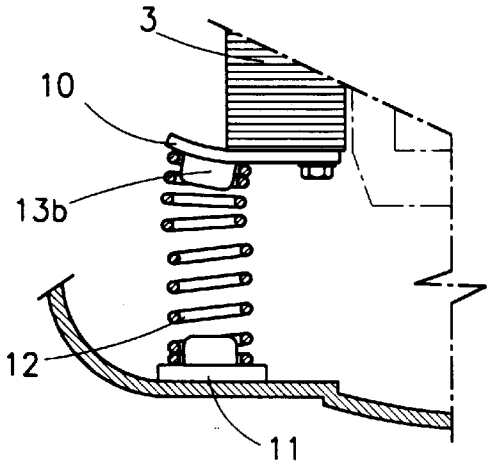
FIG.3 CONVENTIONAL ART
FIG. 3 is a partial cross-sectional view illustrating a stator stopper structure in which a stator stopper is undesirably bent in the conventional hermetic compressor.
Figure 4:
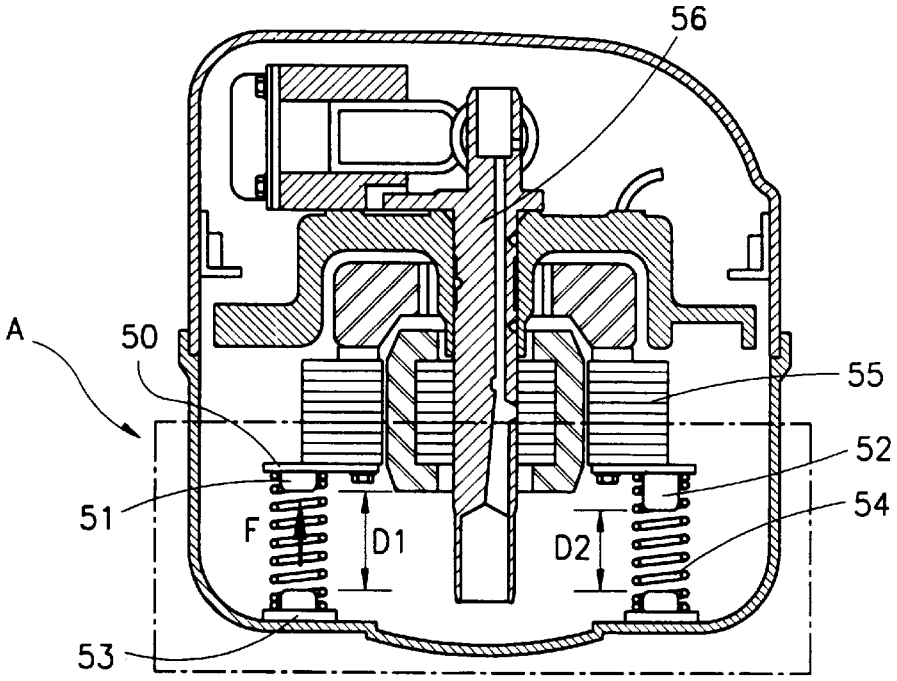
FIG. 4 is a cross-sectional view illustrating a hermetic compressor embodying a stator stopper structure according to the present invention.

In FIG. 4, the respective elements other than the stator stopper structure in the hermetic compressor are identical to those of the conventional hermetic compressor, and accordingly their description will be omitted.

Figure 5:
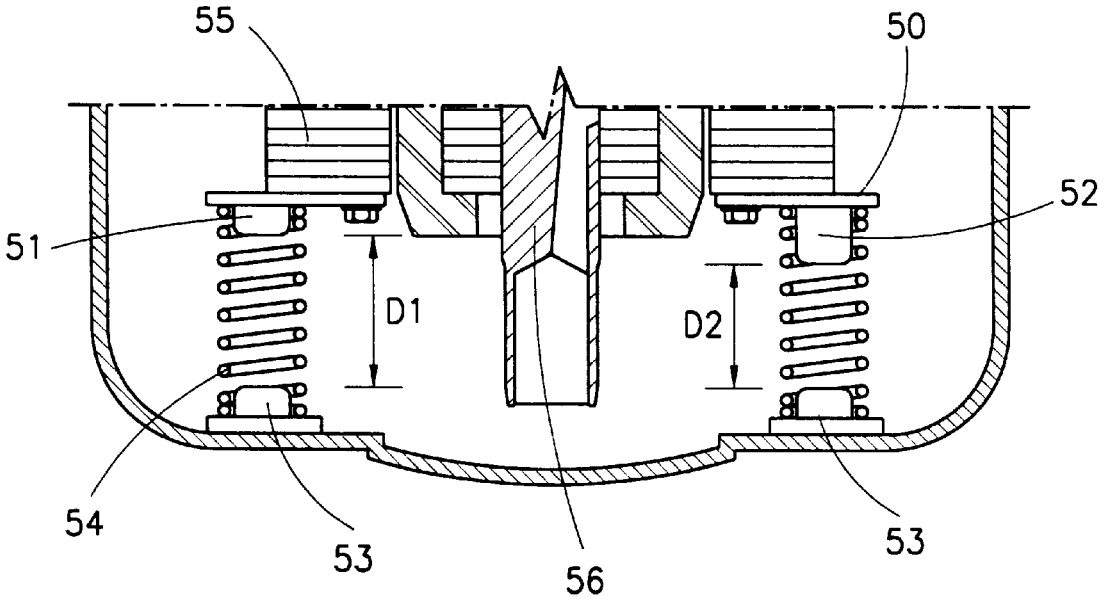
FIG. 5 is an enlarged view detailing a portion A in FIG. 4.

As shown in FIGS. 4 and 5, in the stator stopper structure for a hermetic compressor according to the present invention, each of a pair of stator stoppers 50 includes a pair of spring supports 51, 52 extended downwardly from lower marginal surface portions thereof, wherein the spring supports 51, 52 are different in length from each other. In particular, a dimension D1 between the spring support 51 extended from the stator stopper 50 and a corresponding spring seat 53 is larger than a dimension D2 between the spring support 52 and its corresponding spring seat 53.

When there occurs a sudden impact while handling or transporting the hermetic compressor, which may cause a vertical displacement of the stator, the resultant operation of the thusly constituted hermetic compressor including the stator stopper structure according to the present invention will now be explained.

Once there occurs such a vertical impact on the hermetic compressor, the hermetic compressor including the stator 55 makes a vertical reciprocating movement. At this time, as the springs 54 become compressed, the longer spring support 52 comes into a sudden contact with its corresponding spring seat 53 and absorbs the impact, and thereafter the shorter spring support comes into a second contact with its corresponding spring seat 53.

When the shorter spring support 51 is in contact with its corresponding spring seat 53, the impact momentum applied to the shorter spring support 51 represents only the remainder force after the previous absorption of the impact momentum by longer spring support 52, thereby appropriately protecting the shorter spring support 51 and the stator stopper 50 from being damaged.

As described above, the stator stopper structure for a hermetic compressor according to the present invention advantageously makes the spring supports extended downwardly from the lower surface of the stator stopper to have different lengths, and the length of the spring stopper which may easily crook the stator stopper is the shorter, and accordingly when there occurs a vertical impact on the compressor the longer spring support comes firstly into contact with its corresponding spring seat and absorbs the impact for thusly protecting the relatively weaker spring support, thereby preventing the stator stopper from being crooked by a larger bending momentum.

Consequently, the stator stopper structure for a hermetic compressor according to the present invention prevents the hermetic compressor from generating noise which may occur when the undesirably crooked stator stopper incurs a spring compression interruption, and prevents the springs from coming loose undressed from the spring supports.

As the present invention may be embodied in several forms without departing from the spirit of essential characteristics thereof, it should also be understood that the above-described embodiment is not limited by any of the details of the foregoing description, unless otherwise specified, but rather should be construed broadly within its spirit and scope as defined in the appended claim, and therefore all changes and modifications that fall within meets and bounds of the claim, or equivalences of such meets and bounds are therefore intended to embrace the appended claim.

What is claimed is:

1. A stator stopper structure for a hermetic compressor, wherein one of a pair of spring supports extended downwardly from a lower surface of each of a pair of stator stoppers which support a stator in the hermetic compressor is formed shorter than the other of the pair of spring supports.

* * * * *